US005699558A

United States Patent [19]

Min

[11] Patent Number: 5,699,558

[45] Date of Patent: Dec. 23, 1997

[54] GARMENT FOR AUDIO STIMULATION OF FETUS

[76] Inventor: David Min, 800 MacArthur Blvd., Suite 15, Munster, Ind. 46321

[21] Appl. No.: 728,083

[22] Filed: Oct. 9, 1996

[51] Int. Cl.[6] ..... H04R 1/02; A41D 1/20; A41D 13/04

[52] U.S. Cl. ..... 2/48; 2/338; 381/90; 128/775

[58] Field of Search ..... 2/48, 49.1, 49.2, 2/1, 338, 51, 94, 102, 104, 311, 312, 319, 247, 249, 250, 920, 171.2; 128/775, 662.04, 660.01; 381/90, 188, 151, 205, 187

[56] References Cited

U.S. PATENT DOCUMENTS 4,087,864 5/1978 LaBove et al. ..... 2/102
4,301,544 11/1981 Burton .
4,369,526 1/1983 Clutts .
4,589,134 5/1986 Waldron .
4,873,725 10/1989 Mitchell ..... 2/48
5,107,545 4/1992 Potter .
5,109,421 4/1992 Fox ..... 2/338 X
5,211,321 5/1993 Rodriguez ..... 2/102 X
5,491,756 2/1996 Francais ..... 381/90
5,611,085 3/1997 Rasmussen ..... 2/102

*Primary Examiner*—C. D. Crowder
*Assistant Examiner*—Shirra L. Jenkins
*Attorney, Agent, or Firm*—Banner & Witcoff, Ltd.

[57] ABSTRACT

A garment for providing audio stimulation to a fetus by a birth mother includes an apron with a horizontal, center belt affixed thereto, the belt having pouches for appropriately positioning an audio input device and speakers. Additionally, microphone input of the voice of the mother may be provided to enhance fetal stimulation.

6 Claims, 2 Drawing Sheets

GARMENT FOR AUDIO STIMULATION OF FETUS

BACKGROUND OF THE INVENTION

In a principal aspect, the present invention relates to a garment which may be pregnant woman wherein the garment is fabricated to include an audio system positioned against the fetal cavity or womb and which provides music or other audio stimulation for the fetus.

Recent research has indicated that a fetus responds to aural stimulation and that the effect of such aural stimulation may constitute an early teaching experience and may also have an impact on behavior and learning capability of the child after birth. In addition, the sounds of the mother's voice are thought to have a salutary effect upon a fetus.

Recognition of these factors and the import of these factors on fetal health have lead to a need to provide means by which such stimuli can be provided in a safe and efficient manner to a fetus. Factors of this nature contributed to the efforts to develop the present invention.

SUMMARY OF THE INVENTION

Briefly, the present invention comprises a garment having a construction which facilitates audio stimulation of a fetus. Such stimulation may comprise music, for example, or it may comprise the sounds of the voice of the birth mother or any other sounds which are believed or shown to be a positive stimuli to the fetus. Thus the invention comprises a garment capable of being worn by a birth mother and which includes a means for supporting and positioning, in an appropriate and proper manner, audio equipment, including audio speakers, over the fetal cavity or womb. Apparatus such as tape players, which include speakers, are thus combined with an dheld in position appropriately by means of the garment over the fetal cavity or womb. In addition, a microphone system may be utilized alone or in combination with the garment to provide aural audio input appropriately to the fetal cavity or womb.

Thus it is an object of the invention to provide an improved article of clothing which may be utilized to facilitate audio stimulation of a fetus in the fetal cavity or womb.

Yet a further object of the present invention is to provide a garment which may be utilized to effectively, efficiently and safely provide audio stimulation including the sounds of the mother's voice to a fetus in the womb.

Yet a further object of the invention is to provide a garment which properly positions one or more audio speakers appropriately with respect to the fetal cavity or womb so as to maximize audio stimulation of the fetus with a minimum of discomfort to the birth mother.

These and other objects, advantages and features of the invention will be set forth in a detailed description which follows.

BRIEF DESCRIPTION OF THE DRAWING

In the detailed description that follows, reference will be made to the drawing comprised of the following figures.

DESCRIPTION OF THE PREFERRED EMBODIMENT

Figure 1:
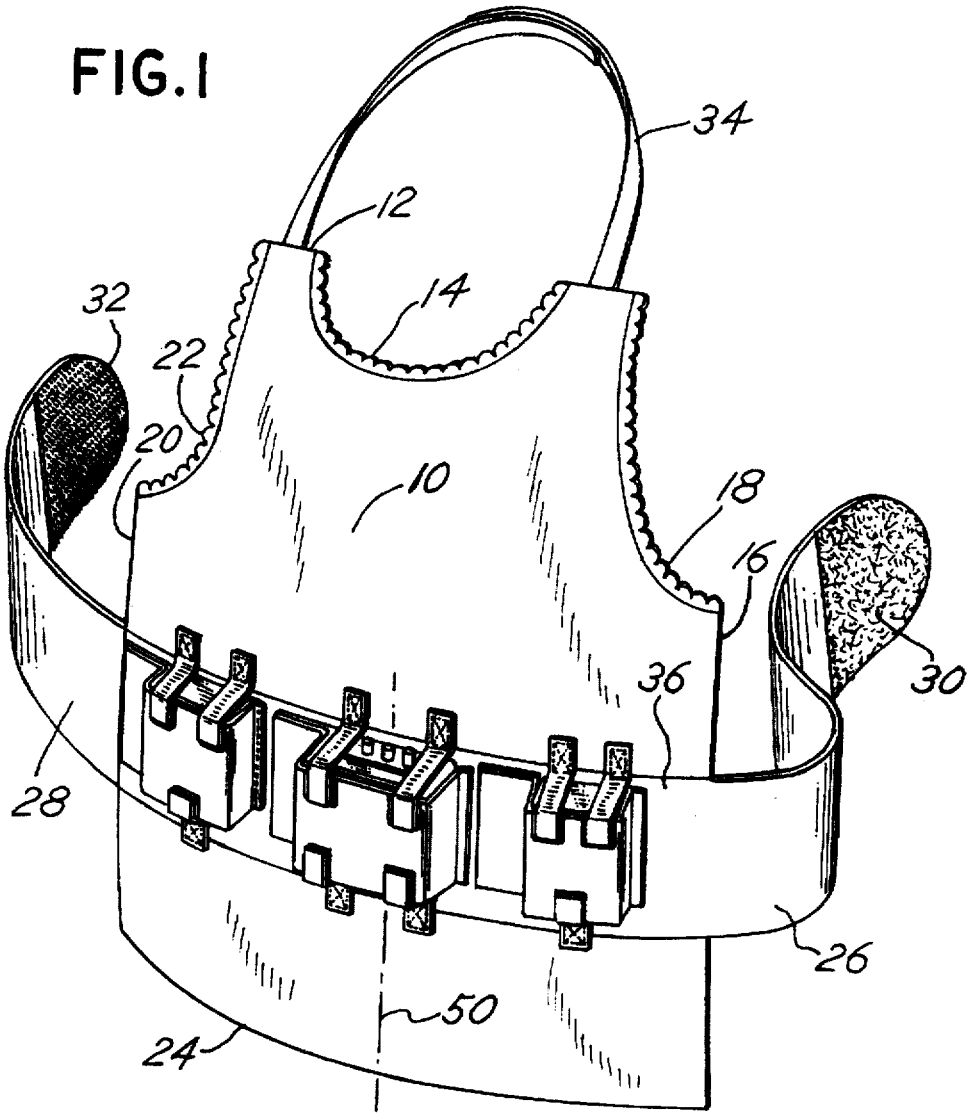
FIG. 1 is an isometric view of a first embodiment of the improved garment of the present invention, including an audio system incorporated with the garment.
Figure 2:
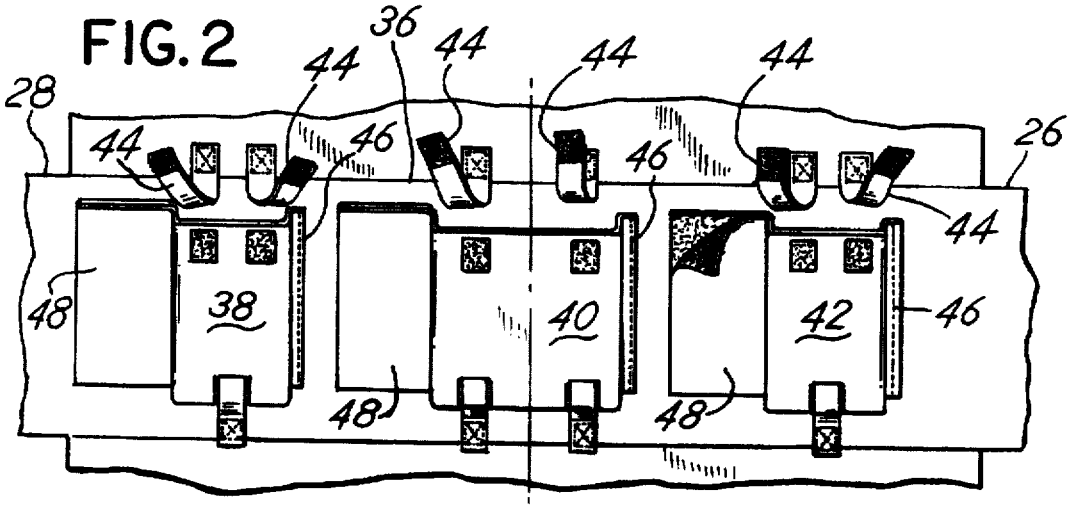
FIG. 2 is a plan view of the belt portion of the garment of FIG. 1 depicting, in greater detail, the arrangement and configuration of compartments or pouches for retaining audio equipment and speakers in a desired and fixed position relative to the fetal cavity.
Figure 3:
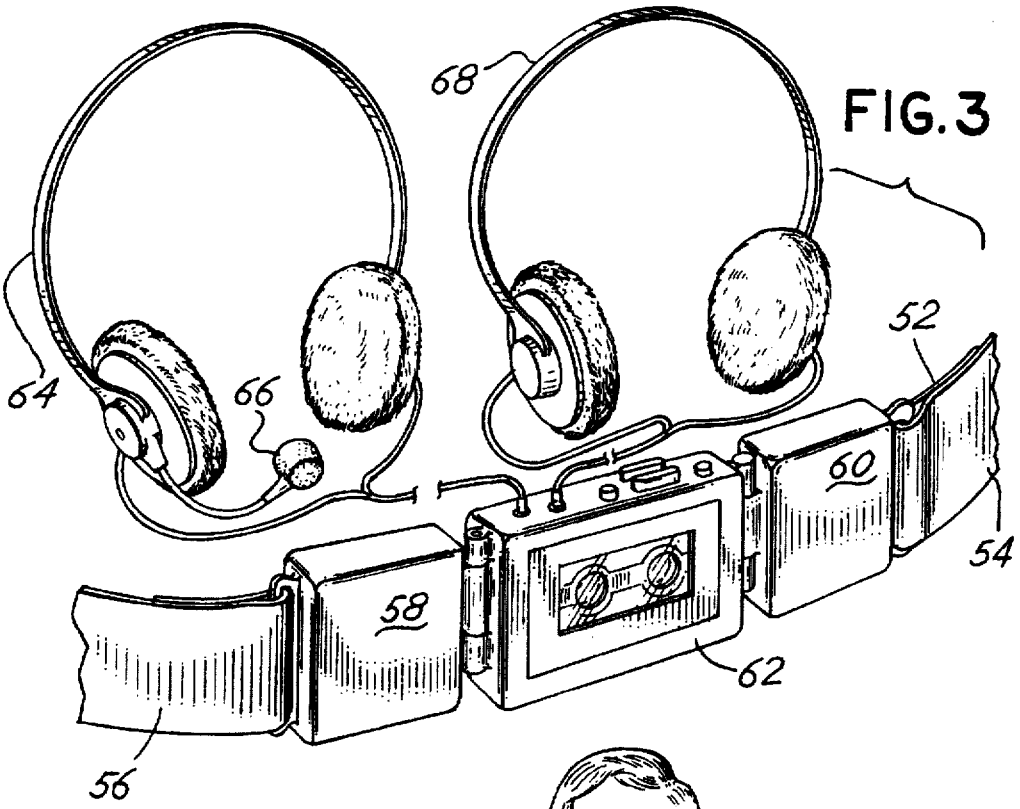
FIG. 3 is an alternative embodiment of the invention as incorporated in a belt structure and farther including a microphone system for providing voice input to the fetal cavity.
Figure 4:
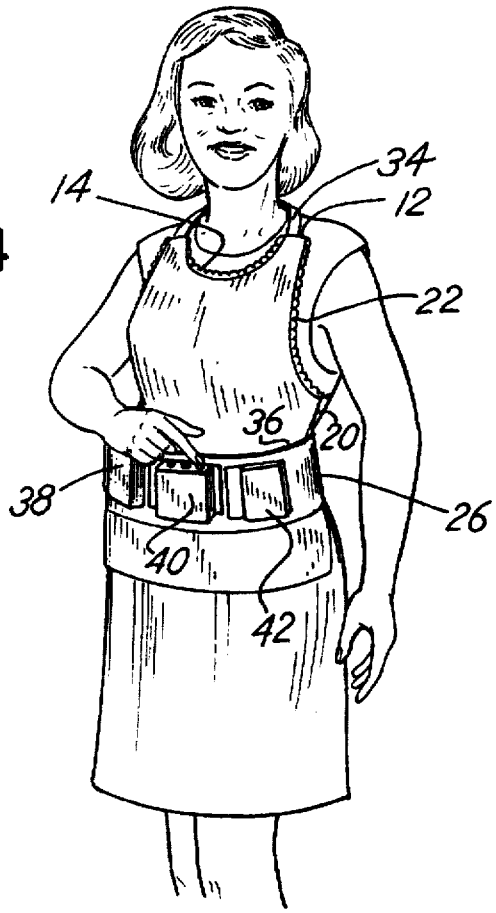
FIG. 4 is a perspective view of the garment of FIG. 1 as it would be utilized by a pregnant woman.

FIGS. 1, 2 and 4 illustrate an embodiment of the invention comprising an apron type garment. FIG. 3 depicts an embodiment of the invention comprising a belt-type garment. Referring first therefore to FIGS. 1, 2 and 4, the garment 10 comprises an apron having a top edge 12 with a scalloped neckline 14, a first side edge 16 with a scalloped arm line 18 and a second side edge 20 with a scalloped arm line 22. Arm lines 18, 22 are connected to the top edge 12. The apron 10 farther includes a bottom edge 24. The apron 10 is fabricated from a flexible fabric having appropriate structural integrity.

Attached to the first side edge 16 is a side edge strap 26. Attached to the second side edge 20 is a strap 28. The straps 26 and 28 include Velcro or hook and loop fasteners 30 and 32 which may be joined about the torso of a pregnant woman to support speakers over the womb, below the rib cage on the front of the torso, as depicted in FIG. 4 to hold the apron 10 appropriately and snugly against the abdomen and over the womb of the pregnant woman. A neck loop 34 is attached to the top edge 12. The length of the neck loop 34 is adjustable so as to permit appropriate positioning of the apron 10 in a vertical direction and thus the position of the audio input section of the apron 10 as described below.

The apron 10 includes a generally horizontal belt or band 36 which in the embodiment, depicted in FIGS. 1 and 2, is coextensive or aligned with the straps 26 and 28 and constitutes a reinforced sector of the apron 10 stretching horizontally about the body of the pregnant woman which utilizes the apron 10. The belt section 36 in a preferred embodiment has a width of approximately 16 centimeters and includes three (3) separate compartments or pouches 38, 40 and 42 positioned in line horizontally and spaced one from the other on the belt section 36. The pouches 38 and 42 are each designed to receive and retain an audio speaker wherein the speaker is positioned so that the face of the speaker is over the abdominal cavity and womb. The center pouch or compartment 40 is adapted to receive an audio input device, for example, a tape player or disc player. Preferably the dimensions associated with the pouches 38 and 42 are approximately 11 centimeters in height and 7 centimeters in width. The center compartment or pouch 40 is approximately 11 centimeters by 11 centimeters.

Velcro straps or fasteners 44 are provided for all of the compartments 38, 40 and 42. The compartments 38, 40 and 42 are preferably stitched along one side and attachable by means of a Velcro fastener along their opposite vertical side to belt section 36. For example, pouch 38 is stitched along vertical side 46. Opposite side 48 is attached to belt 36 by means of a removable Velcro fastener. The same configuration or general construction is provided for each of the pouches or compartments 38, 40 and 42. Alternatively, the pouches 38, 40 and 42 are sewn along three sides to the belt section 36. Fasteners are then provided to retain the speakers and audio input device in those pouches 38, 40 and 42. The straps or fasteners 44 may be replaced by other fastening means. The vertical side of the pouch, such as side 48, retains a speaker in position and permits some adjustment in the lateral dimension of the pouch thereby accommodating speakers of various size. The same construction may be provided for the other compartments 40 and 42. Preferably, the pouches for the speakers are positioned on the belt 36 so that they are aligned on the front side of the torso or abdominal cavity or womb. Thus the range of the centerline of speakers in section 36 pouches 38 and 42 is approximately 15 to 35 centimeters from the center of the belt section 36 or, in other words, in the range of 15 to 35 centimeters on either side of the centerline axis 50 of the belt section 36. Various other arrangements of the audio speakers may be utilized though the described embodiment is preferred.

FIG. 3 illustrates a configuration or construction which eliminates the use of the full apron and provides a belt 52 having straps 54 and 56 which are designed to fasten about the back of the pregnant woman to hold integrated speaker members 58 and 60 as well as attached center audio input device 62 in the appropriate position over the abdomen and womb of a pregnant woman. The embodiment of FIG. 3 further includes a first headphone 64 with a microphone input device 66 that may be worn by the birth mother so as to provide voice input to the fetus. Alternatively, a headphone 68 may be utilized. The headphone 68 is designed merely to sense of the sound that may be emanating from the fetus, that is, the speakers 58 and 60 may also have an audio receiving capability. The headphone and/or microphone configuration can also be used with the apron embodiment.

Various combinations and permutations of pouches and belt constructions are possible and may be utilized within the scope of the invention. Thus the invention is to be limited only by the following claims and their equivalents.

What is claimed is:

1. A garment for providing audio stimulation to a fetus comprising in combination:

a fabric apron having a top edge, side edges and a bottom edge;

a tie strap on each side edge for fitting about the body of the mother and connectable to maintain the apron positioned against the abdomen and opposed to the womb of the mother;

at lease one speaker pocket on the front of the apron juxtaposed over the fetal cavity, said pocket including means for retaining an audio speaker positioned over the fetal cavity in the pocket; and an audio source for the speaker, said audio source also retained on the front of the apron.

2. The garment of claim 1, including two spaced, audio speaker pockets on the apron frame, said pockets being generally horizontally aligned and positioned on the apron to oppose the forward half of the torso of the mother below the rib cage.

3. The garment of claim 2 wherein the pockets are separated by an audio source pocket.

4. The garment of claim 1 further including a neck loop attached to the top edge for fitting around the neck of the birth mother for support of the apron.

5. The garment of claim 1 further including an audio source which includes a microphone for the mother to input her sounds directly to the fetal cavity through a speaker in the speaker pocket.

6. The garment of claim 3 wherein the neck loop is adjustable to permit adjustment of the vertical position of the speaker pocket.

* * * * *